US007927160B1

(12) United States Patent
Noble et al.

(10) Patent No.: US 7,927,160 B1
(45) Date of Patent: Apr. 19, 2011

(54) VARIABLE PITCH PROPELLER

(75) Inventors: Mark Noble, Pleasant Prairie, WI (US); Richard McChesney, Waukegan, IL (US); Laverne Tatge, Kenosha, WI (US); George Broughton, Wadsworth, IL (US)

(73) Assignee: BRP US Inc., Sturtevant, WI (US)

( * ) Notice: Subject to any disclaimer, the term of this patent is extended or adjusted under 35 U.S.C. 154(b) by 607 days.

(21) Appl. No.: 11/962,372

(22) Filed: Dec. 21, 2007

(51) Int. Cl.
*B63H 3/04* (2006.01)

(52) U.S. Cl. ..... 440/50; 416/168 R

(58) Field of Classification Search ..... 440/50; 416/162, 157 R, 168 R, 212 R, 147–168 A
See application file for complete search history.

(56) References Cited

U.S. PATENT DOCUMENTS

| | | | | |
|---|---|---|---|---|
| 657,844 | A * | 9/1900 | Williams et al. | 416/167 |
| 907,298 | A * | 12/1908 | Sintz | 416/153 |
| 3,092,186 | A * | 6/1963 | MacLean | 416/162 |
| 3,403,735 | A * | 10/1968 | Langhjelm et al. | 416/140 |
| 3,645,644 | A | 2/1972 | Schwisow | |
| 5,102,301 | A * | 4/1992 | Morrison | 416/163 |
| 5,762,474 | A | 6/1998 | Chatelain | |
| 6,896,564 | B2 | 5/2005 | Willmot | |

FOREIGN PATENT DOCUMENTS

| | | |
|---|---|---|
| EP | 0464085 B1 | 1/1994 |
| EP | 0328966 A1 | 8/1998 |

* cited by examiner

*Primary Examiner* — Ed Swinehart
(74) *Attorney, Agent, or Firm* — Osler, Hoskin & Harcourt LLP

(57) ABSTRACT

A propeller assembly has first and second propeller blades pivotably mounted on a propeller hub. The first and second propeller blades are pivotable with respect to the propeller hub about corresponding first and second pivot axes to vary a pitch of the first and second propeller blades. A support member has a first end at least partially disposed within the first propeller blade and a second end at least partially disposed within the second propeller blade. The first end has a first central longitudinal axis generally coaxial with the first pivot axis. The second end has a second central longitudinal axis generally coaxial with the second pivot axis. A gear case having a propeller and a marine outboard engine having a propeller are also disclosed.

11 Claims, 5 Drawing Sheets

VARIABLE PITCH PROPELLER

FIELD OF THE INVENTION

The present invention relates to a variable pitch propeller, specifically for a marine outboard engine.

BACKGROUND OF THE INVENTION

Many boats and other watercraft are driven by one or more inboard or outboard engines or a stern drive system, driving one or more propellers. Each propeller typically has three or four blades, but may have as few as two or as many as five or six. The blades are mounted at an angle, or pitch, relative to a radial axis transverse to the axis of rotation of the propeller shaft. Propellers may be constructed with blades having a fixed pitch. The fixed pitch is typically at an angle that provides maximum efficiency at normal cruising speeds, however fixed pitch propellers typically have reduced efficiency at lower vehicle speeds. As a result, fixed pitch propellers typically have slower acceleration and increased fuel consumption at lower speeds.

One way to improve the efficiency of propellers at most speeds is to provide a propeller with blades having a variable pitch. One example of a variable pitch propeller is described in U.S. Pat. No. 6,896,564, which is hereby incorporated by reference herein in its entirety. Variable pitch propellers allow for increased efficiency at both low and high speeds, but they are typically less sturdy than fixed pitch propellers because each blade must be configured to rotate about a separate pivot axis and various components must be provided within the propeller hub to allow the pitch to be adjusted. Therefore, the entire propeller cannot be constructed as a single rigid component. When a variable pitch propeller is in use, typically at high rotational speeds, the blades are subjected to strong forces that may cause wear or damage to the propeller.

Therefore, there is a need for a variable pitch propeller having a sturdy construction.

SUMMARY OF THE INVENTION

It is an object of the present invention to ameliorate at least some of the inconveniences present in the prior art.

It is a further object of the present invention to provide a variable pitch propeller having a sturdy construction.

It is a further object of the present invention to provide a variable pitch propeller having a support member at least partially disposed in at least two propeller blades, the two propeller blades having an angle of at least 90 degrees therebetween.

It is a further object of the present invention to provide a gear case with a variable pitch propeller having a support member at least partially disposed in at least two propeller blades, the two propeller blades having an angle of at least 90 degrees therebetween.

It is a further object of the present invention to provide an outboard engine with a variable pitch propeller having a support member at least partially disposed in at least two propeller blades, the two propeller blades having an angle of at least 90 degrees therebetween.

In one aspect, the invention provides a marine outboard engine, comprising a cowling. An engine is disposed in the cowling. A driveshaft is disposed generally vertically. The driveshaft has a first end and a second end. The first end of the driveshaft is operatively connected to the engine. A gear case is disposed generally below the engine. A propeller shaft is disposed at least in part in the gear case. The propeller shaft is oriented generally perpendicularly to the driveshaft. The propeller shaft is operatively connected to the second end of the driveshaft. An actuator is disposed within the gear case. The actuator is movable relative to the gear case between a first position and a second position. A propeller hub is mounted to the propeller shaft. First and second propeller blades are pivotably mounted on the propeller hub. The first and second propeller blades are pivotable with respect to the propeller hub about corresponding first and second pivot axes. Each pivot axis is oriented generally perpendicularly to the propeller shaft. The first and second propeller blades are operatively connected to the actuator such that movement of the actuator between the first position and the second position causes the first and second propeller blades to pivot respectively about the first and second pivot axes to vary a pitch of the first and second propeller blades between a first pitch and a second pitch. A support member has a first end at least partially disposed within the first propeller blade and a second end at least partially disposed within the second propeller blade. The first end has a first central longitudinal axis generally coaxial with the first pivot axis. The second end having a second central longitudinal axis generally coaxial with the second pivot axis.

In a further aspect, the actuator is disposed inside the propeller shaft.

In a further aspect, a third propeller blade is pivotally mounted on the propeller hub. The third propeller blade has a third pivot axis oriented generally perpendicularly to the propeller shaft. The third propeller blade is operatively connected to the actuator such that movement of the actuator between the first position and the second position causes the third propeller blade to pivot about the third pivot axis to vary a pitch of the third propeller blade between the first pitch and the second pitch. The support member further comprises a third end at least partially disposed within the third propeller blade. The third end has a third central longitudinal axis generally coaxial with the third pivot axis.

In a further aspect, the support member is a first support member. Third and fourth propeller blades are pivotably mounted on the propeller hub. The third and fourth propeller blades are pivotable with respect to the propeller hub about corresponding third and fourth pivot axes. Each pivot axis is oriented generally perpendicularly to the propeller shaft. The third and fourth propeller blades are operatively connected to the actuator such that movement of the actuator between the first position and the second position causes the third and fourth propeller blades to pivot respectively about the third and fourth pivot axes to vary a pitch of the third and fourth propeller blades between the first pitch and the second pitch. A second support member has a first end at least partially disposed within the third propeller blade and a second end at least partially disposed within the fourth propeller blade. The first end has a third central longitudinal axis generally coaxial with the third pivot axis. The second end has a fourth central longitudinal axis generally coaxial with the fourth pivot axis.

In a further aspect, the first pivot axis and the second pivot axis form therebetween an angle of 180 degrees. The third pivot axis and the fourth pivot axis form therebetween an angle of 180 degrees. The first pivot axis and the third pivot axis form therebetween an angle of 90 degrees.

In a further aspect, the first support member has an aperture therethrough. A portion of the second support member is disposed in the aperture.

In a further aspect, the first support member and the second support member are formed integrally in a one-piece construction.

In a further aspect, a driving gear is operatively connected to the actuator. First and second driven bevel gears are connected to the first and second propeller blades respectively. The first and second driven bevel gears mesh with the driving gear, such that the movement of the actuator between the first position and the second position rotates the driving gear, rotation of the driving gear rotates the first and second driven bevel gears, and rotation of the first and second driven bevel gears causes the first and second propeller blades to pivot respectively about the first and second pivot axes.

In a further aspect, the support member passes through the first and second driven bevel gears. The first and second driven bevel gears are pivotable with respect to the support member about the first and second pivot axes, respectively.

In a further aspect, an actuator shaft has one of a protrusion and a recess disposed thereon. An actuator housing has the other of the protrusion and the recess disposed thereon. The recess engages the protrusion such that a reciprocating motion of the actuator shaft between the first position and the second position causes a rotation of the actuator housing, and the rotation of the actuator housing causes the rotation of the driving gear.

In an additional aspect, a propeller assembly comprises a propeller hub. First and second propeller blades are pivotably mounted on the propeller hub. The first and second propeller blades are pivotable with respect to the propeller hub about corresponding first and second pivot axes. Each pivot axis is oriented generally perpendicularly to a central axis of the propeller hub. The first and second propeller blades are pivotable respectively about the first and second pivot axes to vary a pitch of the first and second propeller blades between a first pitch and a second pitch. A support member has a first end at least partially disposed within the first propeller blade and a second end at least partially disposed within the second propeller blade. The first end has a first central longitudinal axis generally coaxial with the first pivot axis. The second end has a second central longitudinal axis generally coaxial with the second pivot axis.

In a further aspect, a third propeller blade is pivotally mounted on the propeller hub. The third propeller blade has a third pivot axis oriented generally perpendicularly to the central axis of the propeller hub. The third propeller blade is pivotable about the third pivot axis to vary a pitch of the third propeller blade between the first pitch and the second pitch. The support member further comprises a third end at least partially disposed within the third propeller blade. The third end has a third central longitudinal axis generally coaxial with the third pivot axis.

In a further aspect, the support member is a first support member. Third and fourth propeller blades are pivotably mounted on the propeller hub. The third and fourth propeller blades are pivotable with respect to the propeller hub about corresponding third and fourth pivot axes. Each pivot axis is oriented generally perpendicularly to the central axis of the propeller hub. The third and fourth propeller blades are pivotable respectively about the third and fourth pivot axes to vary a pitch of the third and fourth propeller blades between the first pitch and the second pitch. A second support member has a first end at least partially disposed within the third propeller blade and a second end at least partially disposed within the fourth propeller blade. The first end has a third central longitudinal axis generally coaxial with the third pivot axis. The second end has a fourth central longitudinal axis generally coaxial with the fourth pivot axis.

In a further aspect, the first pivot axis and the second pivot axis form therebetween an angle of 180 degrees. The third pivot axis and the fourth pivot axis form therebetween an angle of 180 degrees. The first pivot axis and the third pivot axis form therebetween an angle of 90 degrees.

In a further aspect, the first support member and the second support member are formed integrally in a one-piece construction.

In an additional aspect, a gear case for a marine outboard engine comprises a gear case housing. A propeller shaft is oriented generally longitudinally in the gear case housing. An actuator is disposed within the gear case housing. The actuator is movable relative to the gear case housing between a first position and a second position. A propeller hub is mounted to the propeller shaft. First and second propeller blades are pivotably mounted on the propeller hub. The first and second propeller blades are pivotable with respect to the propeller hub about corresponding first and second pivot axes. Each pivot axis is oriented generally perpendicularly to the propeller shaft. The first and second propeller blades are operatively connected to the actuator such that movement of the actuator between the first position and the second position causes the first and second propeller blades to pivot respectively about the first and second pivot axes to vary a pitch of the first and second propeller blades between a first pitch and a second pitch. A support member has a first end at least partially disposed within the first propeller blade and a second end at least partially disposed within the second propeller blade. The first end has a first central longitudinal axis generally coaxial with the first pivot axis. The second end has a second central longitudinal axis generally coaxial with the second pivot axis.

In a further aspect, the actuator is disposed inside the propeller shaft.

In a further aspect, a third propeller is blade pivotally mounted on the propeller hub. The third propeller blade has a third pivot axis oriented generally perpendicularly to the propeller shaft. The third propeller blade is operatively connected to the actuator such that movement of the actuator between the first position and the second position causes the third propeller blade to pivot about the third pivot axis to vary a pitch of the third propeller blade between the first pitch and the second pitch. The support member further comprises a third end at least partially disposed within the third propeller blade. The third end has a third central longitudinal axis generally coaxial with the third pivot axis.

In a further aspect, the support member is a first support member. Third and fourth propeller blades are pivotably mounted on the propeller hub. The third and fourth propeller blades are pivotable with respect to the propeller hub about corresponding third and fourth pivot axes. Each pivot axis is oriented generally perpendicularly to the propeller shaft. The third and fourth propeller blades are operatively connected to the actuator such that movement of the actuator between the first position and the second position causes the third and fourth propeller blades to pivot respectively about the third and fourth pivot axes to vary a pitch of the third and fourth propeller blades between the first pitch and the second pitch. A second support member has a first end at least partially disposed within the third propeller blade and a second end at least partially disposed within the fourth propeller blade. The first end has a third central longitudinal axis generally coaxial with the third pivot axis. The second end has a fourth central longitudinal axis generally coaxial with the fourth pivot axis.

In a further aspect, the first pivot axis and the second pivot axis form therebetween an angle of 180 degrees. The third pivot axis and the fourth pivot axis form therebetween an angle of 180 degrees. The first pivot axis and the third pivot axis form therebetween an angle of 90 degrees.

In a further aspect, the first support member and the second support member are formed integrally in a one-piece construction.

In a further aspect, an actuator bevel gear is operatively connected to the actuator. First and second driven bevel gears are connected to the first and second propeller blades respectively. The first and second driven bevel gears mesh with the driving gear, such that the movement of the actuator between the first position and the second position rotates the driving gear, rotation of the driving gear rotates the first and second driven bevel gears, and rotation of the first and second driven bevel gears causes the first and second propeller blades to pivot respectively about the first and second pivot axes.

In a further aspect, the support member passes through the first and second driven bevel gears. The first and second driven bevel gears are pivotable with respect to the support member about the first and second pivot axes, respectively.

In a further aspect, an actuator shaft has one of a protrusion and a recess disposed thereon. An actuator housing has the other of the protrusion and the recess disposed thereon. The recess engages the protrusion such that a reciprocating motion of the actuator shaft between the first position and the second position causes a rotation of the actuator housing, and the rotation of the actuator housing causes the rotation of the driving gear.

In the present application, terms related to spatial orientation such as forwardly, rearwardly, left, and right, should be interpreted are as they would normally be understood by a driver of a watercraft sitting thereon in a normal driving position, when the engine is mounted on the watercraft. When these terms are used in relation to a propeller, they should be interpreted as they would be understood if the propeller were installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
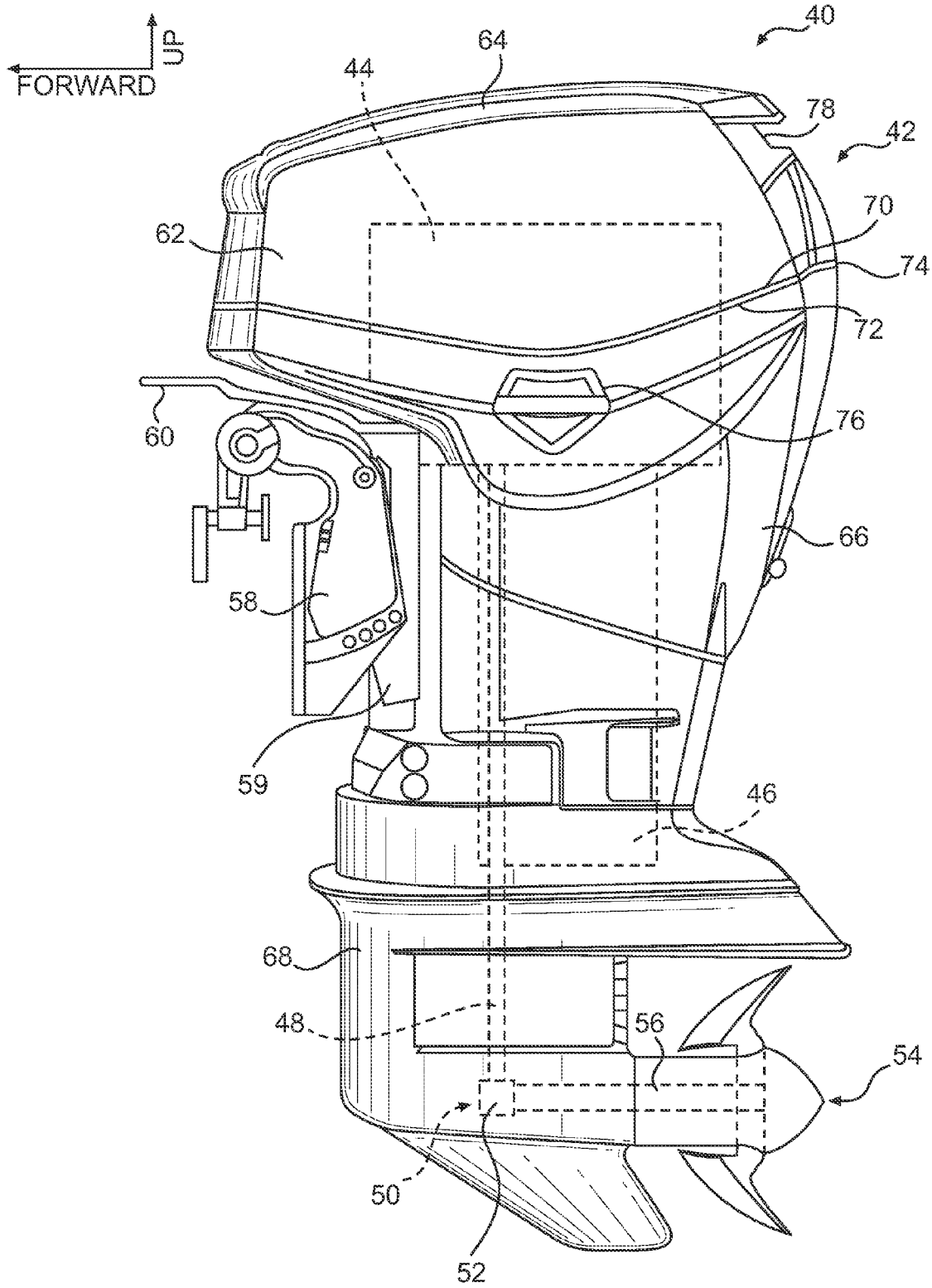
FIG. 1 is a side elevation view of a marine outboard engine to which the present invention can be applied.

Referring to FIG. 1, a marine outboard engine 40 will be described to which the invention can be applied. It should be understood that the present invention is applicable to other marine applications involving propellers, such as inboard engines and stern drives.

FIG. 1 is a side view of a marine outboard engine 40 having a cowling 42. The cowling 42 surrounds and protects an engine 44, shown schematically. The engine 44 may be any suitable engine known in the art, such as an internal combustion engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller assembly 54 (shown schematically) mounted on a propeller shaft 56. The propeller shaft 56 is generally perpendicular to the driveshaft 48. The drive mechanism 50, the propeller assembly 54 and the propeller shaft 56 will be described below in further detail. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard engine 40 to a watercraft. The stern bracket 58 can take various forms, the details of which are conventionally known.

A linkage 60 is operatively connected to the cowling 42, to allow steering of the outboard engine 40 when coupled to a steering mechanism of a boat, such as a steering wheel.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, which will be described below in further detail.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 42.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78.

Alternatively, the air intake portion 78 can be wholly formed in the upper motor cover 62 or even the lower motor cover 66.

Figure 2:
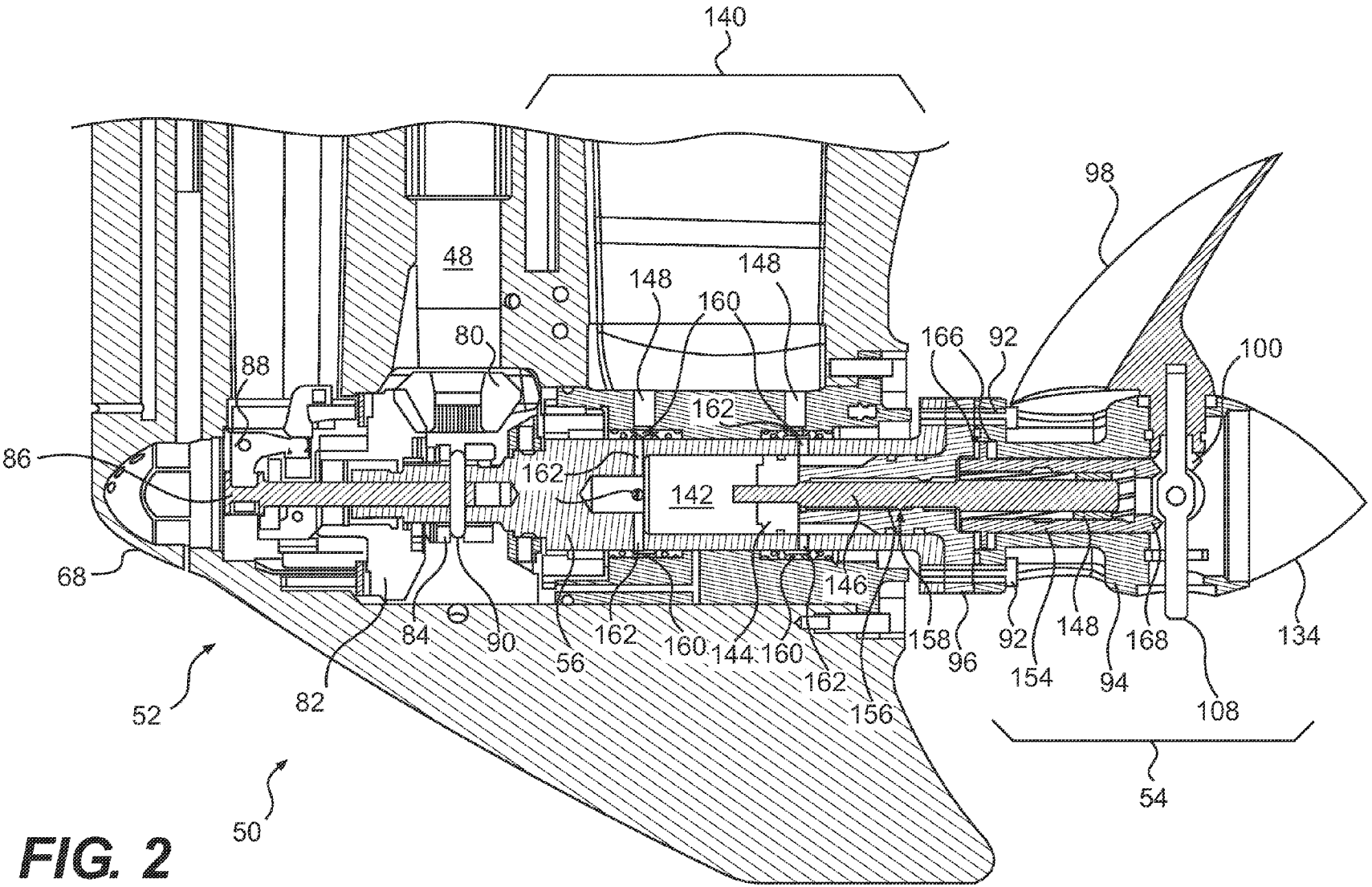
FIG. 2 is a cross-sectional view of a gear case according to the present invention.

Referring to FIG. 2, the drive mechanism 50 will now be described.

A bevel gear 80 is mounted on one end of the driveshaft 48. The bevel gear 80 meshes with the bevel gear 82 that is coaxial with the propeller shaft 56. A clutch gear 84 is splined to the propeller shaft 56 and is coupled to the transmission shaft 86 via the pin 90. The transmission shaft 86 can be actuated by the gear shift lever 88, causing the clutch gear 84 to move axially with respect to the propeller shaft 56. The clutch gear 84 can be moved forwardly to a first position, in which the clutch gear 84 engages the bevel gear 82. In the first position, the driveshaft 48 drives the propeller shaft 56 to propel a watercraft (not shown) in a forward direction. The clutch gear 84 can also be moved to a second position, in which the clutch gear 84 is disengaged from the bevel gear 82. The intermediate position corresponds to a neutral gear position, wherein the propeller shaft 56 is not driven and the watercraft can remain stationary in a body of water and can be safely boarded from the rear. It is contemplated that the drive mechanism 50 may additionally have a reverse gear assembly for driving the propeller shaft 56 in the reverse direction to propel the watercraft in reverse. It is further contemplated that the watercraft may alternatively be driven in reverse by varying the pitch of the propeller blades 98 by a sufficient degree that the watercraft will be propelled in the reverse direction when the propeller shaft is 56 is rotated in the forward direction.

Figure 3:
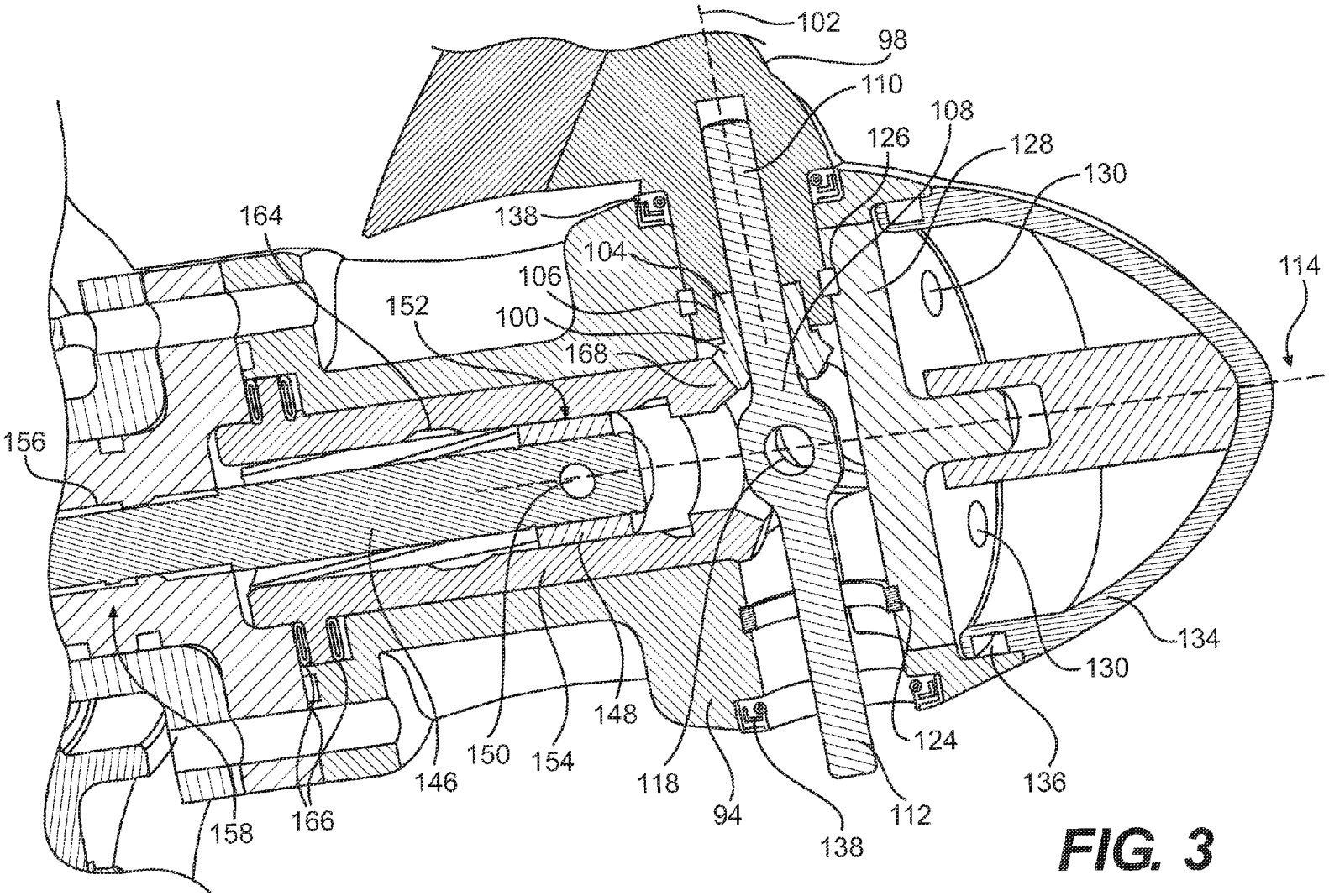
FIG. 3 is a cross-sectional view of a propeller assembly according to the present invention.
Figure 4:
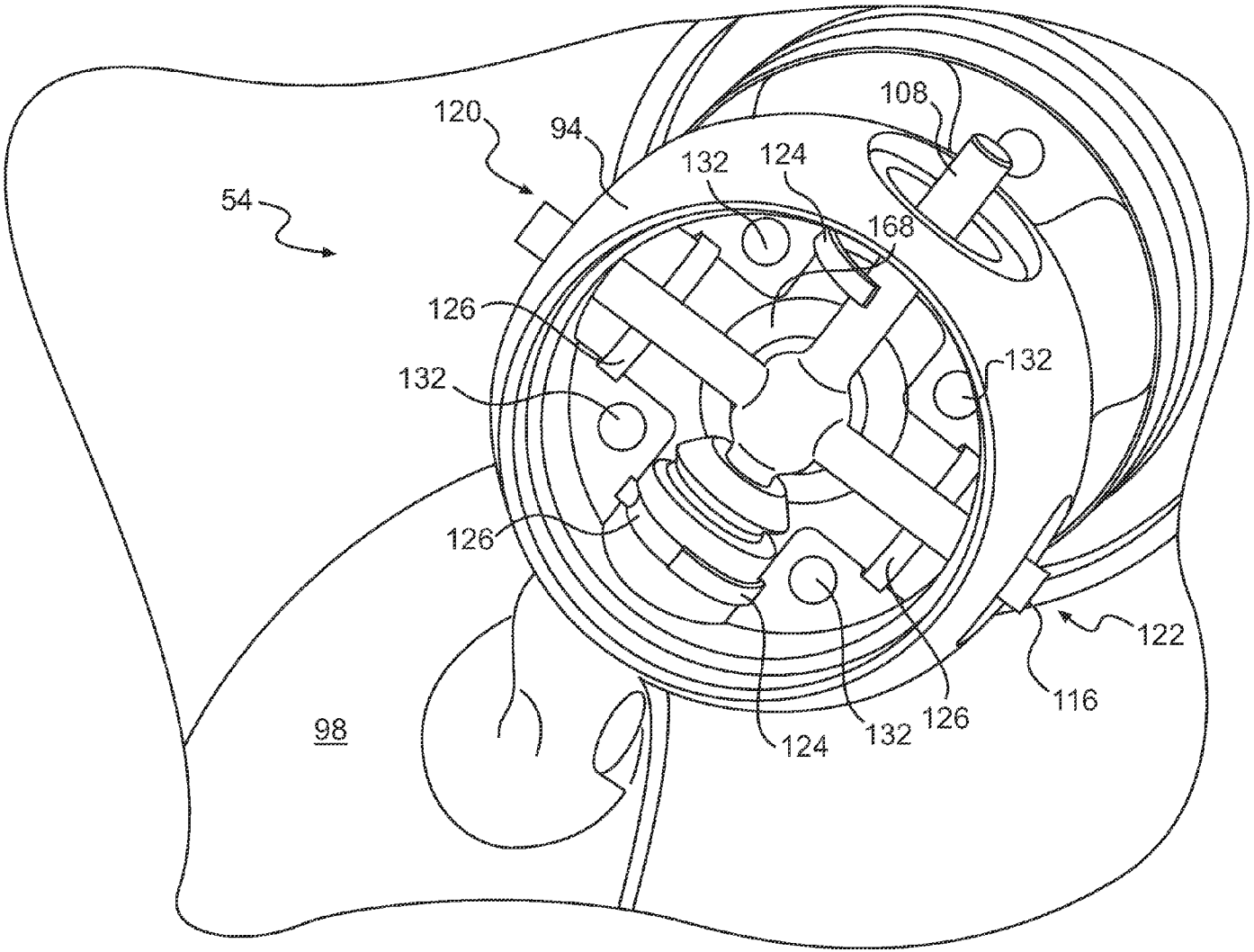
FIG. 4 is a perspective view, taken from a rear, right side of a propeller assembly according to a first embodiment of the present invention.

Referring to FIGS. 2-4, a propeller assembly 54 will now be described according to a first embodiment.

The propeller assembly 54 is mounted to the propeller shaft 56 via bolts 92 inserted through flanges in the propeller hub 94, the shaft housing 96 and the propeller shaft 56. The function of the shaft housing 96 will be explained below in further detail.

The propeller assembly 54 includes four propeller blades 98 disposed 90 degrees from each other (one of which is shown in FIGS. 2 and 3) received in the hub 94. Sealing rings 138 provide a water-tight seal between the hub 94 and the blades 98. Each blade 98 has a corresponding bevel gear 100. A D-shaped or otherwise non-circular end 104 of the bevel gear 100 is received in a complementarily-shaped aperture 106 in the corresponding blade 98, such that rotating the bevel gear 100 causes the blade 98 to pivot about the pivot axis 102 to vary the pitch of the blade 98. It is contemplated that the blade 98 may be connected to the bevel gear 100 by any other suitable connection, such as a spline connection. It is further contemplated that the bevel gear 100 may be formed integrally with the blade 98 in a one-piece construction. The bevel gears 100 are rotated by the pinion gear 168 in a manner that will be described in further detail below.

Retaining rings 124 are received in recesses 126 formed in part between the blades 98 and the hub 94 to retain the blades 98 in the hub 94. A blade retainer 128 is inserted into the hub 94 rearwardly of the blades 98 and cooperates with the blades 98 to form a second portion of the recesses 126. The blade retainer 128 is attached to the hub 94 via bolts (not shown) received in the apertures 130 (FIG. 3) in the blade retainer 128 and the apertures 132 in the hub 94. A cap 134 is received in the rear portion of the hub 94. The cap 134 improves the aesthetic and hydrodynamic properties of the propeller assembly 54. A sealing ring (not shown) is received in the recess 136 between the cap 134 and the hub 94 to form a water-tight seal.

A support member 108 has a first end 110 received in a first blade 98 and the bevel gear 100, and a second end 112 for being received in a second blade 98 (not shown) disposed at a 180 degree angle from the blade 98 on the opposite side of the central axis 114 of the hub 94. The first end 110 has a central longitudinal axis coaxial with the pivot axis 102 of the blade 98, and both the blade 98 and bevel gear 100 pivot with respect to the first end 110 when the pitch of the blade 98 is varied. The second end 112 is substantially of the same construction as the first end 110, and will not be described in detail. When the outboard engine 40 is in operation, the propulsive force generated by the outboard engine 40 creates forces on each blade 98, creating a bending moment at the base of the blade 98. The forces exerted on the blades 98 on opposite sides of the axis 114 when the propeller assembly 54 is in operation are borne by the support member 108 extending therebetween, thereby reducing the stresses on the blade 98, the hub 94 and other parts of the propeller assembly 54. It should be understood that the two blades 98 that receive the ends 110, 112 of the support member 108 need not have an angle of 180 degrees therebetween to obtain the benefit of the present invention. As long as at least two blades 98 that receive the support member 108 are more than 90 degrees apart, the stress on the propeller assembly 54 will be reduced at least partially, and some benefit will be realized.

Referring now to FIG. 4, a second support member 116 is received through an aperture 118 in the support member 108. The support member 116 is oriented at 90 degrees to the support member 108. The support member 116 has first and second ends 120, 122 that are received in third and fourth blades 98 (not shown) having respective bevel gears 100 (not shown). The third and fourth blades 98 are oriented 180 degrees apart from each other, and each of the third and fourth blades 98 is oriented 90 degrees apart from each of the first and second blades 98. It is contemplated that the support members 108 and 116 may alternatively be integrally cast or forged as a single support member.

Figure 5:
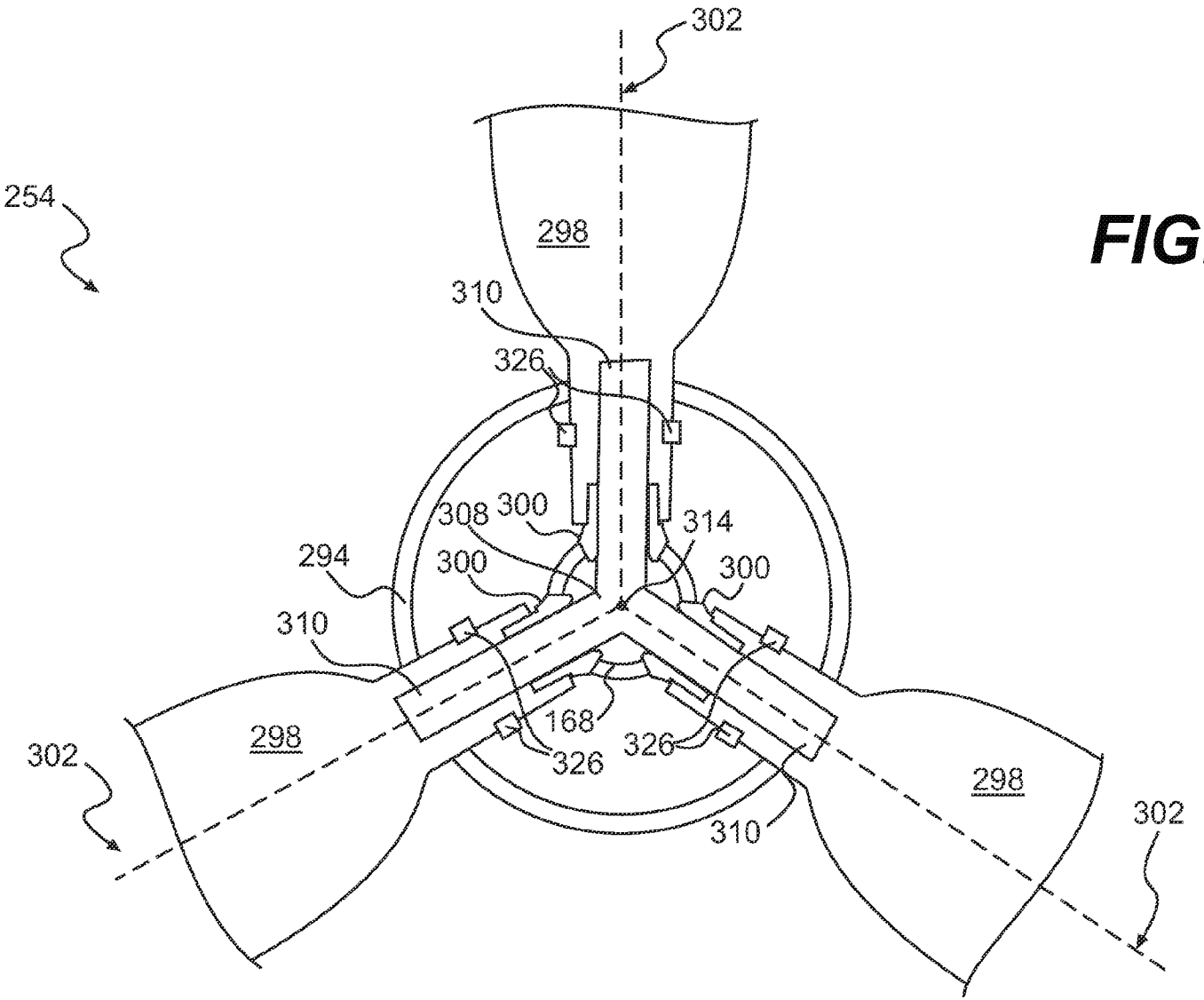
FIG. 5 is a cross-sectional view of a propeller assembly according to a second embodiment of the present invention.

Referring to FIG. 5, the propeller assembly 254 will now be described according to a second embodiment.

The propeller assembly 254 includes three propeller blades 298 received in the hub 294. Each blade 298 is attached to a corresponding bevel gear 300 in the same manner as the embodiment shown in FIGS. 2-4, such that the blades 298 pivot about their respective pivot axes 302 to vary the pitch of the blades 298 when the bevel gears 300 are rotated by the pinion gear 168 in a manner that will be described in further detail below.

A support member 308 has three ends 310 received in the three blades 298 and the corresponding bevel gears 300. Each end 310 has a central longitudinal axis coaxial with the pivot axis 302 of the blade 298 in which it is received, and both the blade 298 and bevel gear 300 pivot with respect to the end 310 when the pitch of the blade 298 is varied. The forces exerted on the blades 298 when the propeller assembly 254 is in operation will be borne by the support member 308 extending therebetween, thereby reducing the stresses on the blade 98, the hub 294 and other parts of the propeller assembly 254. It should be understood that the support member 308 may alternatively have more than three ends 310 for supporting an equal number of blades 298, in which case the forces on the blades 298 will at least partially offset each other as long as at least two of the blades are spaced apart by more than 90 degrees.

Retaining rings (not shown) are received in the recesses 326 to retain the blades 298 in the hub 294 in a manner similar to the retaining rings 124 of the embodiment shown in FIGS. 2-4.

Referring back to FIGS. 2-4, the variable pitch system will now be described.

The variable pitch system is operated by an actuator 140 in the form of a linear hydraulic actuator. The actuator 140 includes a housing 142 formed inside the propeller shaft 56 and a piston 144 that can reciprocate within the housing 142. The reciprocating movement of the piston 144 drives the shaft 146, which extends through an end of the housing 142, through the shaft housing 96 and into an actuator housing in the form of a tube 154. The shaft housing 96 has a longitudinal groove 156 formed therein, and the shaft 146 has a corresponding protrusion 158. The groove 156 and protrusion 158 cooperate to prevent relative rotation between the shaft 146 and the shaft housing 96 about the longitudinal axis of the shaft 146. It is contemplated that the groove 156 may alternatively be formed in the shaft 146, in which case the protrusion 158 would be formed on the shaft housing 156.

Conduits 148 integrally formed in the gear case 68 are connected to annular conduits 160 formed in the gear case 68 and extending around the propeller shaft 56, to deliver hydraulic fluid to the conduits 160. A number of radial channels 162 formed through the propeller shaft 56 provide paths for the hydraulic fluid to flow between the conduits 160 and the interior of the housing 142. As hydraulic fluid is delivered to and removed from the housing 142 on either side of the piston 144, the piston 144, and therefore the shaft 146, reciprocates within the housing 142 as would be understood by those skilled in the art.

The rearward end of the shaft 146 has a gear 148 mounted thereon via a pin (not shown) inserted through an aperture (not shown) in the gear 148 and through the aperture 150 in the shaft 146, such that the gear 148 does not move relative to the shaft 146. It is contemplated that other methods of mounting the gear 148 to the shaft 146 may be used, such as a spline connection between the gear 148 and the shaft 146, or E-rings placed on the shaft 146 on either side of the gear 148. It is further contemplated that two or more of these methods of mounting the gear 148 to the shaft 146 may be used in combination, to provide a more secure fit.

The gear 148 has a protrusion thereon in the form of a helical thread 152. The tube 154 has a corresponding recess in the form of a helical groove 164. It is contemplated that the protrusion may instead be disposed on the tube 154, in which case the corresponding recess would be disposed in the gear 148. When the shaft 146 reciprocates within the housing 142, the thread 152 and the groove 164 cooperate to cause the tube 154 to rotate about the axis 114. Face bearings 166 are provided between the tube 154 and the shaft housing 96, as well as between the tube 154 and the hub 94, to reduce the friction therebetween. It is contemplated that the protrusion 152 and the corresponding recess 164 may alternatively be of any other suitable shape as long as the protrusion 152 and the corresponding groove 164 causes the tube 154 rotate about the axis 114 in response to reciprocation of the shaft 146. When the tube 154 rotates, the pinion gear 168 on the rearward end of the tube 154 drives the bevel gears 100 to vary the pitch of the blades 98 about the respective pivot axes. It is further contemplated that any suitable actuator may alternatively be used to vary the pitch of the blades 98.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine, comprising:

a cowling;

an engine disposed in the cowling;

a driveshaft disposed generally vertically, the driveshaft having a first end and a second end, the first end of the driveshaft being operatively connected to the engine;

a gear case disposed generally below the engine;

a propeller shaft disposed at least in part in the gear case, the propeller shaft being oriented generally perpendicularly to the driveshaft, the propeller shaft being operatively connected to the second end of the driveshaft;

an actuator disposed within the gear case, the actuator being movable relative to the gear case between a first position and a second position;

a propeller hub mounted to the propeller shaft;

first, second, third and fourth propeller blades pivotably mounted on the propeller hub, the first, second, third and fourth propeller blades being pivotable with respect to the propeller hub about corresponding first, second, third and fourth pivot axes, each pivot axis being oriented generally perpendicularly to the propeller shaft, the first, second, third and fourth propeller blades being operatively connected to the actuator such that movement of the actuator between the first position and the second position causes the first, second, third and fourth propeller blades to pivot respectively about the first, second, third and fourth pivot axes to vary a pitch of the first, second, third and fourth propeller blades between a first pitch and a second pitch;

a first support member having a first end at least partially disposed within the first propeller blade and a second end at least partially disposed within the second propeller blade, the first end having a first central longitudinal axis generally coaxial with the first pivot axis, the second end having a second central longitudinal axis generally coaxial with the second pivot axis; and a second support member having a first end at least partially disposed within the third propeller blade and a second end at least partially disposed within the fourth propeller blade, the first end having a third central longitudinal axis generally coaxial with the third pivot axis, the second end having a fourth central longitudinal axis generally coaxial with the fourth pivot axis.

2. The marine outboard engine of claim 1, wherein the actuator is disposed inside the propeller shaft.

3. The marine outboard engine of claim 1, wherein:

the first pivot axis and the second pivot axis form therebetween an angle of 180 degrees;

the third pivot axis and the fourth pivot axis form therebetween an angle of 180 degrees; and the first pivot axis and the third pivot axis form therebetween an angle of 90 degrees.

4. The marine outboard engine of claim 3, wherein the first support member has an aperture therethrough, and wherein a portion of the second support member is disposed in the aperture.

5. The marine outboard engine of claim 3, wherein the first support member and the second support member are formed integrally in a one-piece construction.

6. The marine outboard engine of claim 1, further comprising:

a driving gear operatively connected to the actuator; and first, second, third and fourth driven bevel gears connected to the first, second, third and fourth propeller blades respectively, the first, second, third and fourth driven bevel gears meshing with the driving gear, such that the movement of the actuator between the first position and the second position rotates the driving gear, rotation of the driving gear rotates the first, second, third and fourth driven bevel gears, and rotation of the first, second, third and fourth driven bevel gears causes the first, second, third and fourth propeller blades to pivot respectively about the first, second, third and fourth pivot axes.

7. The marine outboard engine of claim 6, wherein the first support member passes through the first and second driven bevel gears;

wherein the first and second driven bevel gears are pivotable with respect to the first support member about the first and second pivot axes, respectively;

wherein the second support member passes through the third and fourth driven bevel gears; and wherein the third and fourth driven bevel gears are pivotable with respect to the second support member about the third and fourth pivot axes, respectively.

8. The marine outboard engine of claim 6, wherein the actuator comprises:

an actuator shaft having one of a protrusion and a recess disposed thereon; and an actuator housing having the other of the protrusion and the recess disposed thereon, the recess engaging the protrusion such that a reciprocating motion of the actuator shaft between the first position and the second position causes a rotation of the actuator housing, and the rotation of the actuator housing causes the rotation of the driving gear.

9. A propeller assembly comprising:

a propeller hub;

first, second, third and fourth propeller blades pivotably mounted on the propeller hub, the first, second, third and fourth propeller blades being pivotable with respect to the propeller hub about corresponding first, second, third and fourth pivot axes, each pivot axis being oriented generally perpendicularly to a central axis of the propeller hub, the first, second, third and fourth propeller blades being pivotable respectively about the first, second, third and fourth pivot axes to vary a pitch of the first, second, third and fourth propeller blades between a first pitch and a second pitch;

a first support member having a first end at least partially disposed within the first propeller blade and a second end at least partially disposed within the second propeller blade, the first end having a first central longitudinal axis generally coaxial with the first pivot axis, the second end having a second central longitudinal axis generally coaxial with the second pivot axis; and a second support member having a first end at least partially disposed within the third propeller blade and a second end at least partially disposed within the fourth propeller blade, the first end having a third central longitudinal axis generally coaxial with the third pivot axis, the second end having a fourth central longitudinal axis generally coaxial with the fourth pivot axis.

10. The propeller assembly of claim 9, wherein:

the first pivot axis and the second pivot axis form therebetween an angle of 180 degrees;

the third pivot axis and the fourth pivot axis form therebetween an angle of 180 degrees; and the first pivot axis and the third pivot axis form therebetween an angle of 90 degrees.

11. The propeller assembly of claim 9, wherein the first support member and the second support member are formed integrally in a one-piece construction.

* * * * *